United States Patent [19]

Joa

[11] 4,141,193

[45] Feb. 27, 1979

[54] HORIZONTAL DIAPER GROUPER

[76] Inventor: Curt G. Joa, Box 1121, Boynton Beach, Fla. 33435

[21] Appl. No.: 814,948

[22] Filed: Jul. 12, 1977

[51] Int. Cl.[2] ..... B65B 63/02

[52] U.S. Cl. ..... 53/529; 53/542; 198/408; 198/419

[58] Field of Search ..... 198/406, 408, 419, 422, 198/429, 462; 53/159, 124 D, 124 C

[56] References Cited

U.S. PATENT DOCUMENTS

| | | | |
|---|---|---|---|
| 1,974,931 | 9/1934 | Rose | 198/408 |
| 2,275,709 | 3/1942 | Wilcox | 198/408 |
| 2,482,427 | 9/1949 | Melhorn | 198/419 |
| 3,107,793 | 10/1963 | Frank | 198/419 |
| 3,122,870 | 3/1964 | Stemmler | 53/159 |
| 3,557,688 | 1/1971 | Hartbauer | 53/124 D |
| 3,810,344 | 5/1974 | Evans et al. | 53/124 D |
| 3,824,759 | 7/1974 | Finn et al. | 53/124 D |
| 3,927,508 | 12/1975 | Campbell | 198/408 |

*Primary Examiner*—Robert B. Reeves

*Assistant Examiner*—Richard K. Thomson

*Attorney, Agent, or Firm*—Wheeler, Morsell, House & Fuller

[57] ABSTRACT

Apparatus for use with a pad stacking and packing machine for diapers or the like includes means for tipping vertical pad stacks on end and grouping two stacks together in a horizontal row or group of pads, with the group discharged as a unit into a shipping container. In one embodiment a conveyor with a vertical run and curved run picks up the pad stacks and turns them on edge and carries them to a grouping station where the stacks are accumulated into a group and the group is laterally discharged into a shipping container. In another embodiment, a turret which rotates about a horizontal axis receives the diapers in magazines arranged around the turret. The vertical and compressed stacks of diapers coming off the stack forming machine are loaded into the magazines at one position of the turret and the turret is rotated 90° to position the pads on edge at the container loading station.

8 Claims, 7 Drawing Figures

HORIZONTAL DIAPER GROUPER

BACKGROUND OF INVENTION

Conventional pad stacking apparatus for diapers or the like provides a stack of vertical pads which are pushed laterally into cartons. My prior U.S. Pat. No. 2,324,930 is exemplary of prior art pad stacking apparatus. My earlier U.S. Pat. No. 2,131,808, particularly FIGS. 20 and 21, shows apparatus for assembling pads in a horizontal array but doesn't disclose apparatus for grouping vertical stacks which have been compressed and subsequently tilted on edge with the group of stacks being discharged laterally as a unit into a shipping package. In addition, my prior U.S. Pat. No. 2,131,808 does not show apparatus for compressing the horizontal array of pads prior to lateral discharge and maintaining the compression of the pads during subsequent handling and orienting of the pads.

SUMMARY OF INVENTION

The invention provides an adapter or an accessory for a diaper or pad stacking machine to turn the pads on edge and assemble or group the pad stacks in a horizontal array of pads in a larger group or count of pads than is normally handled with a vertical pad stacker and packer. With conventional pad stacking apparatus, diaper stacks of up to twenty diapers are easily handled. With the apparatus of the invention, two vertical stacks totaling approximately forty diapers oriented in a horizontal row can be handled and packed in bags or cartons.

In one embodiment of the invention, the pads are shifted laterally from an existing pad stacker onto the flights of a conveyor which carries the pads in a vertical stack upwardly around a 90° bend and onto a horizontal run, with the pads thus in a horizontal array on edge rather than stacked one upon another. The conveyor delivers two pad stacks in succession to the grouping and unloading station. When the desired horizontal group of pads is formed at the grouping station, a horizontally movable pusher compresses the pads against a fixed stop and maintains the compression while the pads are shifted laterally from the conveyor by a pusher ram through a loading funnel and into a bag or carton.

In a modified embodiment of the invention, a turret having four sides with pad magazines located on each of the four sides rotates about a horizontal axis to position the magazine at the discharge end of the pad stacker. Once a magazine is loaded, the turret is rotated 90° to position the pads in a horizontal row on edge. The pads are ejected from the magazine by horizontally movable pushers. The magazine walls maintain the pad stacks in their compressed state while the pads are moved to the unloading station.

Further objects, advantages and teachings of the invention will become apparent from the disclosure hereof.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
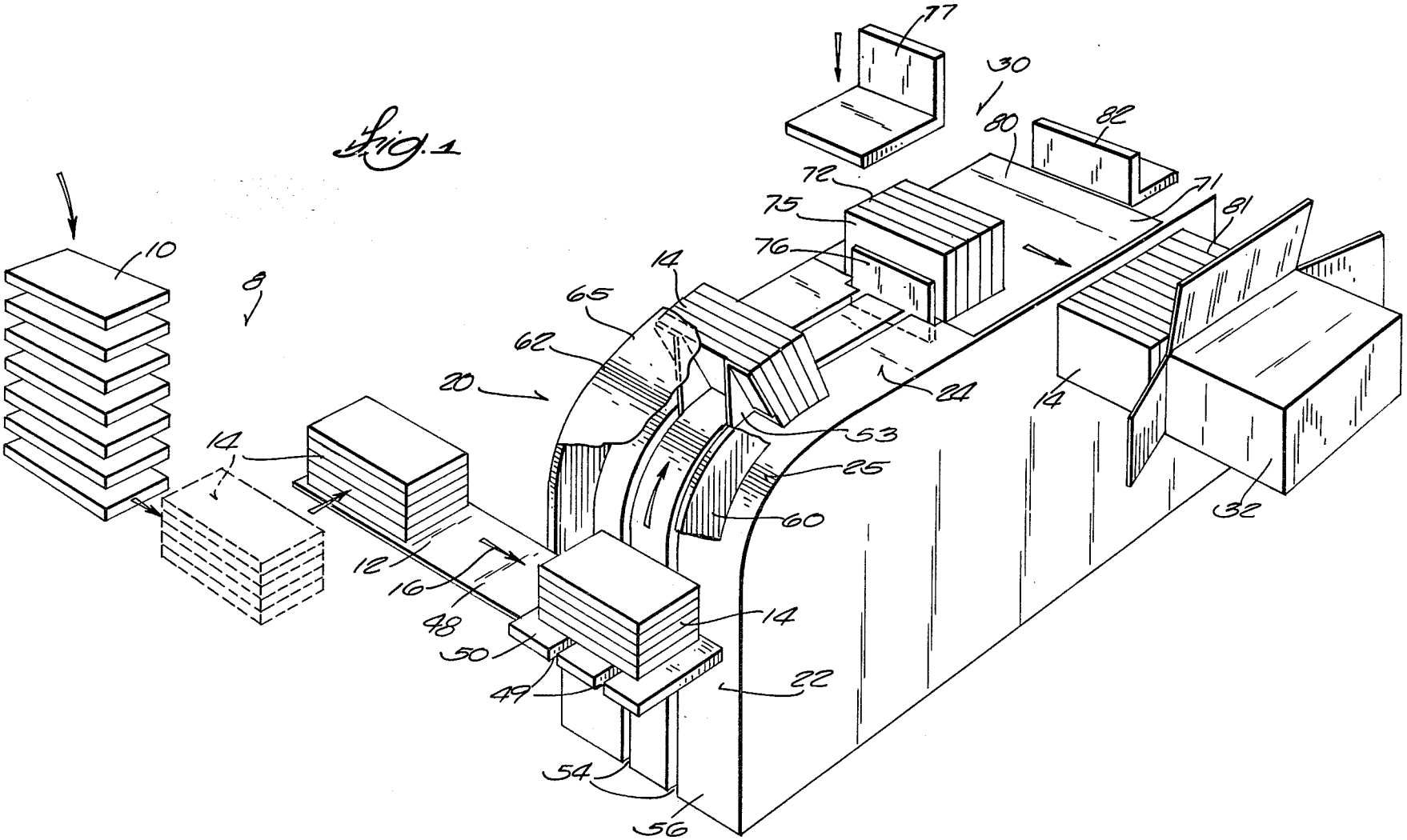
FIG. 1 is a diagrammatic perspective view of apparatus in accordance with the invention.
Figure 2:
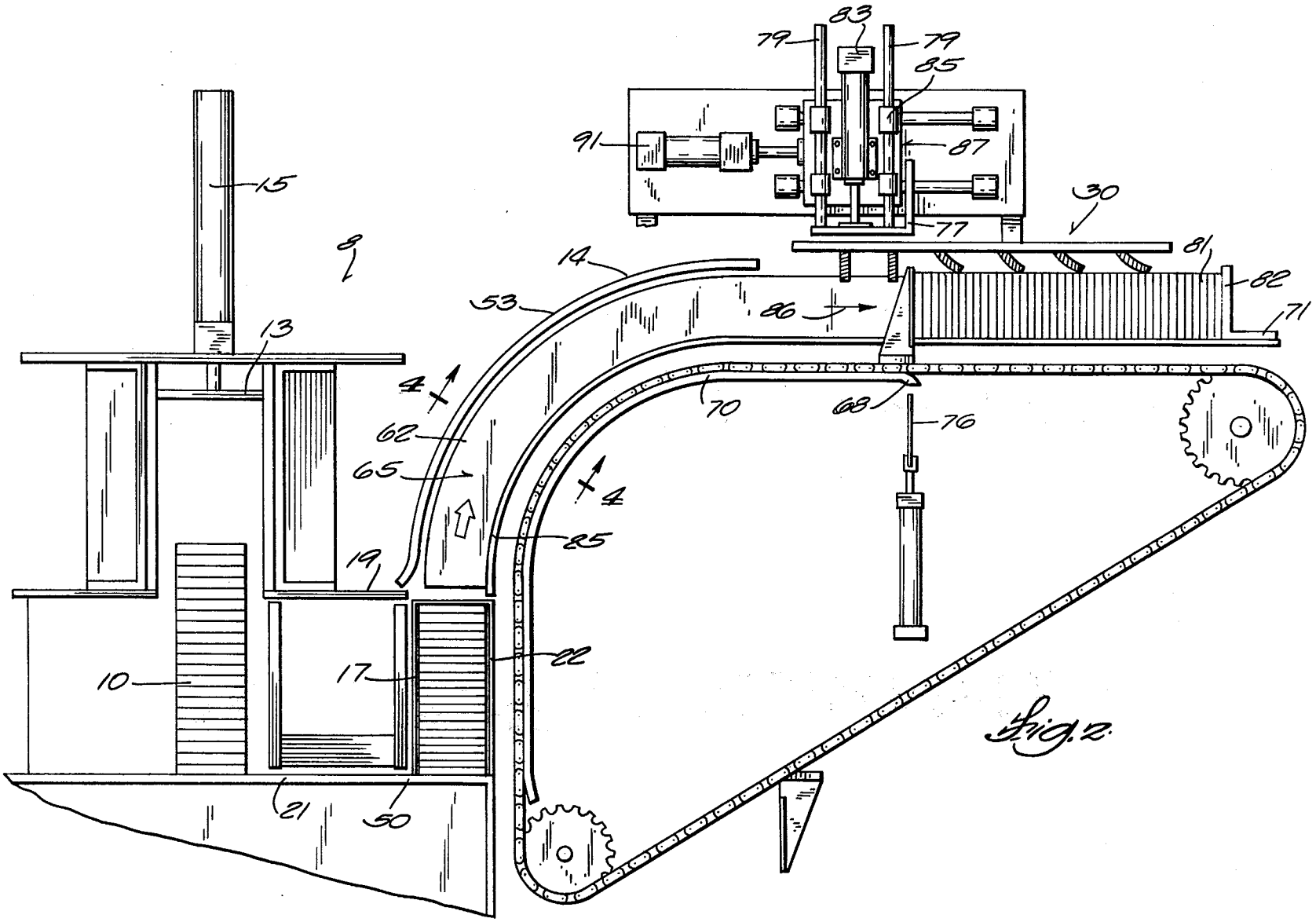
FIG. 2 is a diagrammatic side elevational view of pad packing apparatus of the invention.
Figures 3, 4:
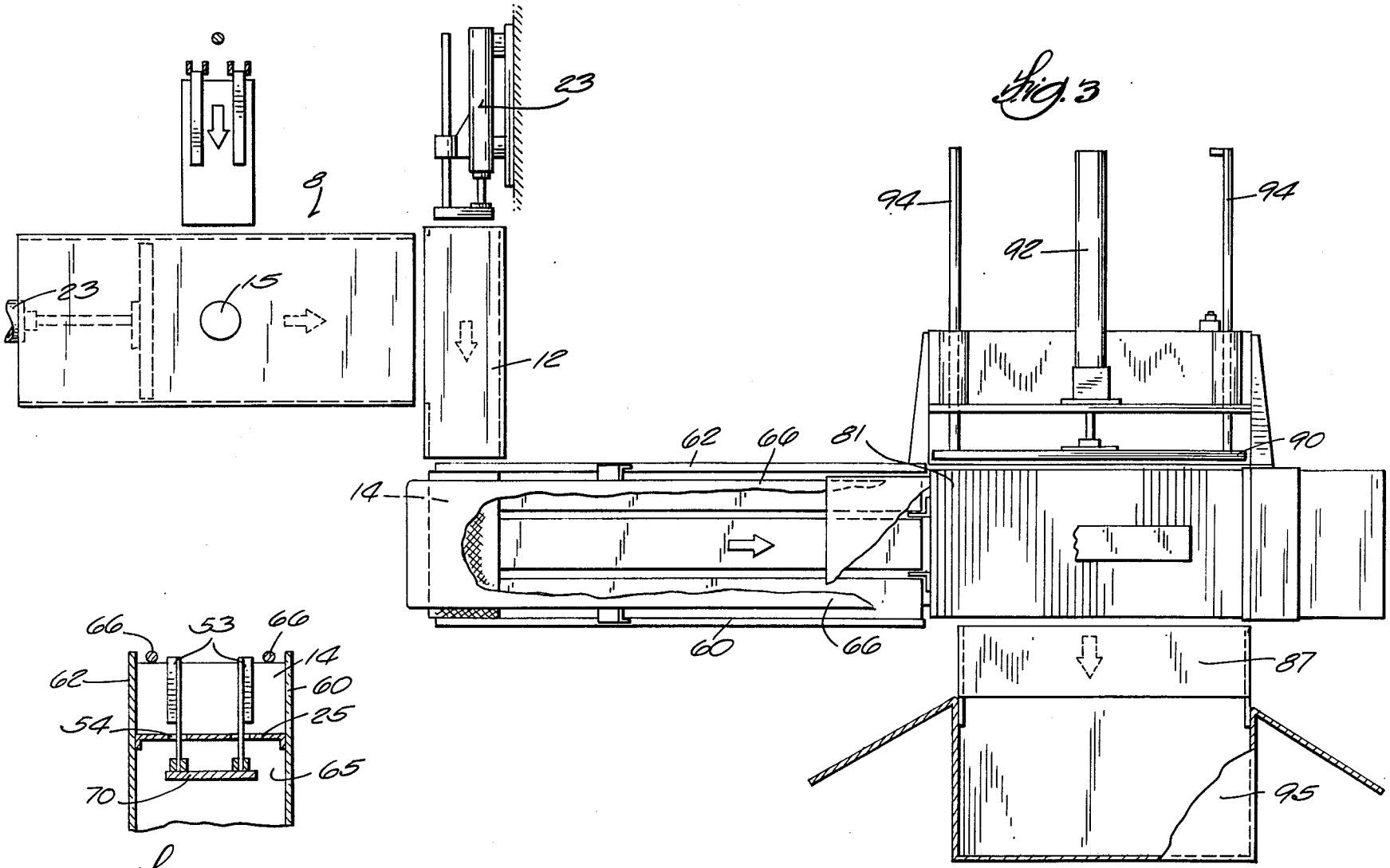
FIG. 3 is a plan view of the apparatus shown in FIG. 2.
FIG. 4 is a sectional view along line 4—4 of FIG. 2.

While the invention broadly relates to packing any article, it will be exemplified herein as applied to compressible pads such as sanitary napkins, hospital pads and disposable baby diapers, and particularly diapers. Referring to FIGS. 1, 2 and 3, a conventional diaper or pad stacking and packing device 8 forms a vertical pad stack 10 which is compressed into a stack 14 by a vertically movable pusher plate 13 operated by a power cylinder 15 (FIG. 2). The stack 14 is shifted laterally while the stack is maintained under compression by top plate 19 and bottom plate 21 to a discharge station which typically would include a loading funnel 17. The pad stack 14 is discharged laterally as indicated by the arrow 16 (FIG. 1) by a horizontal ram operated pusher 23 (FIG. 3). The pusher 23 pushes the vertical pad stacks 14 through a packing funnel 12 (FIG. 3). The apparatus thus far described is conventional.

The invention provides an attachment or adapter for the pad stacking and packing device 8 to receive the vertical stacks from the packing funnel 12 and tip the pad stacks on edge and group two stacks together for discharge as a unit. Orienting and grouping means are provided for tipping the pad stacks and the pads on edge and to group the pad stacks together in a horizontal array. In the construction disclosed in FIGS. 1–4, the means includes a conveyor 20 which receives the stack 14 along a vertical run 22 and conveys the stack 14 upwardly, along a curved run 25 onto a horizontal run 24 where the pad stack 14 is thus tilted so that the pads are on edge rather than in a vertical stack with one pad on top of another. Two or more stacks 14 can be accumulated at the discharge station 30, as subsequently described, and simultaneously discharged laterally into a bag or carton 32.

A loading plate 50 (FIG. 1) is associated with the conveyor 20 and is co-planar with the lower supporting surface 48 of the funnel 12. The pad stacks 14 are pushed laterally onto the plate 50 in sequence by the pusher 23. The stacks 14 are picked off the plate 50 by conveyor flights 53. Slots 49 in the plate 50 and slots 54 in the bed 56 of conveyor 20 enable the conveyor flights 53 to move past the plate 50 to elevate the pad stacks on the vertical run 22 and along the curved run 25. The conveyor 20 also includes two spaced side walls 60 and 62 which provide a channel 65 to confine the pads in the stack against shifting during movement of the stacks from the loading plate 50 to the unloading station 30. Overhead arcuate plates or guide rails 66 hold the stacks 14 in the conveying channel 65 and against the bed 56 during movement of the stacks 14 to the horizontal conveyor run 24. The conveyor flights 53 drop down at point 68 (FIG. 2) when they move beyond the track 70 and when the first stack of the group is delivered to a skid plate 71. A movable stop 76 can be elevated from below the conveying path to the position shown in FIG. 1 to abut the last pad 75 in the stack and prevent the stack from toppling rearwardly.

As the next stack 14 is moved by the flights 53 toward the first stack 14 at position 72, the stop plate 76 is lowered from the conveying path and pressure from the next stack 14 and conveyor flights 53 will push the first stack 14 to the extreme position 80 against a stop plate 82 (FIG. 2). After two diaper stacks have been grouped against the stop plate 82, the group 81 of diapers is compressed. For this purpose, a pressure plate 77 (FIGS. 1, 2) connected to slide rods 79 movable in guides 85 on carriage 87 is lowered into the conveying path by a power cylinder 83. The carriage 87 and plate 77 are then moved in the direction of arrow 86 by power cylinder 91 to compress the group 81.

As shown in FIG. 3, the compressed group 81 of two stacks 14 is then discharged through a loading funnel 87 by a horizontal pusher plate 90 powered by power cylinder 92 and guided by guide rods 94. The pad group 81 is received in a shipping carton 95 or bag. A second group 81 of pads can be loaded into the same bag.

Figure 5:
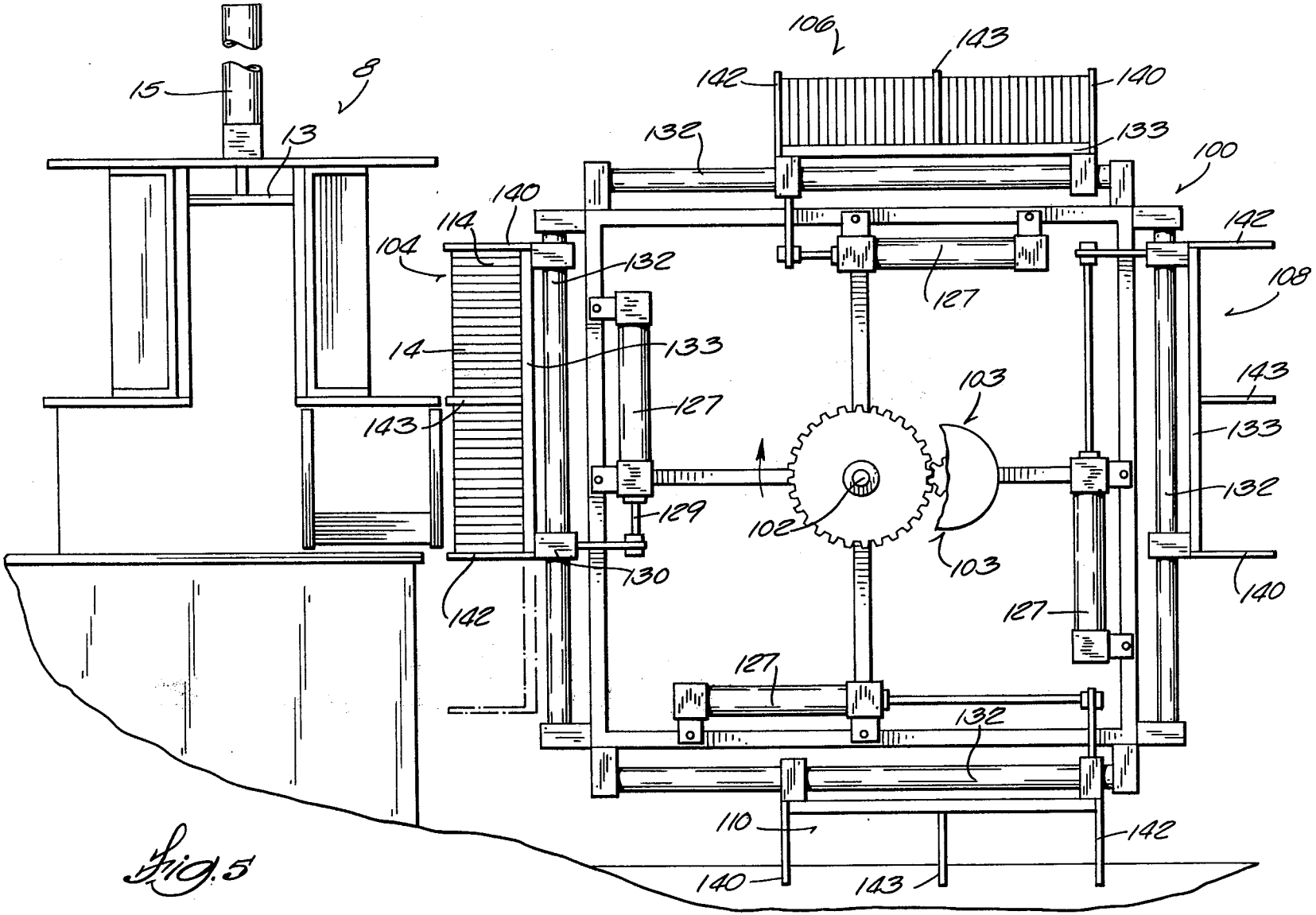
FIG. 5 is a diagrammatic side elevational view of a modified embodiment of the apparatus of the invention.
Figure 6:
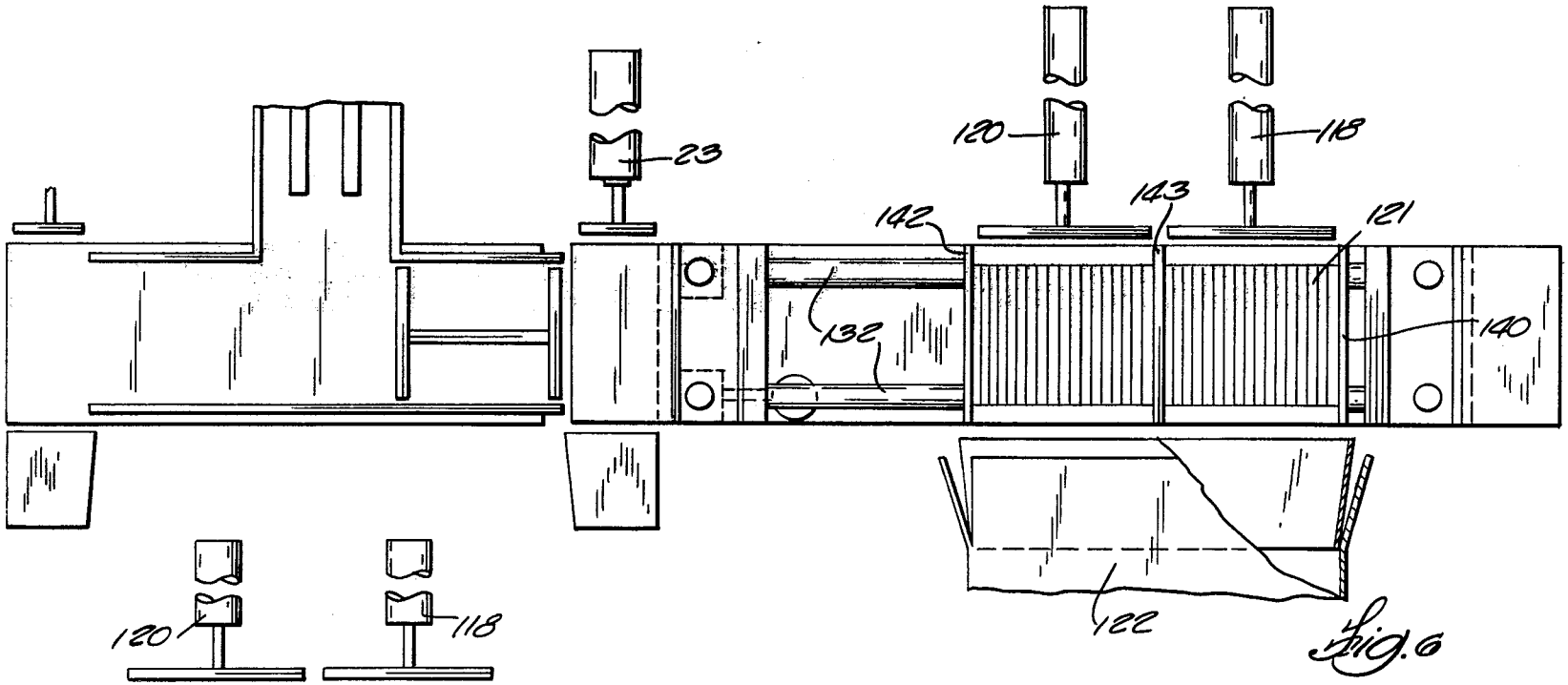
FIG. 6 is a plan view of the apparatus shown in FIG. 5.
Figure 7:
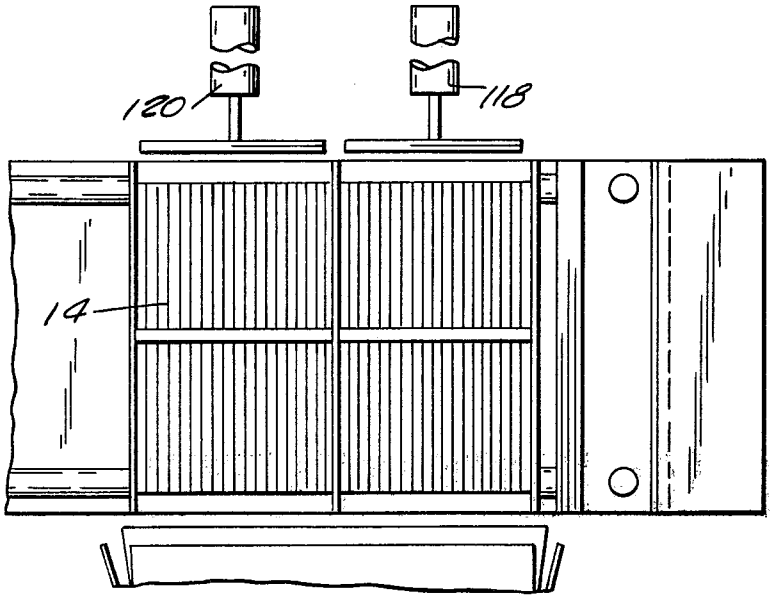
FIG. 7 is a fragmentary view of a further modified embodiment of the apparatus shown in FIGS. 5 and 6.

FIGS. 5, 6 and 7 show a modified embodiment of the invention in which the means for grouping and tipping the diaper stacks 14 discharged by the pad stacker 8 includes a turret 100 which is rotatable about a horizontal axis 102 by gear and motor drive means 103 or other suitable means. The turret includes magazines 104, 106, 108 and 110 arranged around the turret periphery. Each of the magazines has two magazine compartments or bins to receive a vertical stack 14 of diapers. After the upper compartment 114 receives a stack, the magazine is shifted vertically upwardly from the broken line position shown in FIG. 5 by a power cylinder 127, solenoid or the like which has a piston rod 129 connected to a magazine slide 130. The magazine slides 130 are integrally connected by a bracket or magazine base 133 and are supported on guide rods 132 to afford shifting movement of the magazines relative to the turret. When both magazine compartments have been filled, the turret is indexed to position magazine 110 in position for loading at the pad stacker 8. Prior to indexing the turret 100, the filled magazine 106 which contains two stacks 14 on edge, is unloaded by two pusher rams 118 and 120 (FIG. 6) which push the pad group 121 laterally into a carton or bag 122.

FIG. 7 shows a further modified embodiment in which each of the magazines 119 have sufficient depth to receive two stacks 14 in each magazine compartment in end-to-end relationship. The stacks 14 are pushed from each compartment of the magazine by pushers 120 and 118.

In the embodiment illustrated in FIGS. 5, 6 and 7, the only stack compression is provided by ram 15 and plate 13. The stacks are maintained in compression throughout the tipping sequence and unloading sequence by the end walls 140 and 142 and dividers 143 of the magazines.

What I claim is:

1. In apparatus for packing pads including means for stacking pads in vertical stacks the improvement comprising orienting and grouping means for tipping the pad stacks to place the pads on edge and group two stacks together in a horizontal array on a skid plate, said orienting and grouping means including conveyor means having transverse conveying runs, means for loading vertical stacks in sequence on said conveying means, said conveyor means including flights which traverse a generally vertical run and a curved run connecting said vertical and horizontal runs with said flights being indexible to a horizontally extending stack loading position for receiving a pad stack from said means for stacking pads and being indexible to a group forming station along said horizontal run, pad stop means associated with said skid plate, a pressure plate, pressure plate movement means for advancing and retracting said pressure plate transversely into and from the path of movement of said pads along said horizontal run and said skid plate, said pressure plate movement means including carriage means to move said pressure plate toward said pad stop means to compress pads against said stop means, and means for discharging said horizontal array of grouped and compressed pads as a unit laterally into a container from said skid plate.

2. The improvement of claim 1 wherein said flights of said conveyor means leave said horizontal conveying path when said stacks are deposited on said skid plate and including a movable stop associated with said horizontal conveyor run, and means for moving said stop behind a stack of pads on said skid plate to prevent toppling of said stack prior to completion of a group of stacks.

3. The improvement of claim 1 including side walls along said vertical and curved conveyor runs, said walls defining a channel for confining the pad stacks to prevent shifting of pads in the stacks during movement of the stacks along the vertical and curved runs.

4. Apparatus for re-orienting and grouping vertical stacks of compressible pads on edge comprising a turret, a plurality of walls defining pad magazines carried by said turret, each of said magazines having first and second loading bins separated by a divider with each bin sized to accommodate a pad stack, slide means for mounting said magazine walls on said turret for movement between first and second positions relative to said turret, and power cylinder means on said turret for moving said magazines between said first and second positions to afford sequential and independent loading of stacks in each of said first and second magazine bins, means for indexing said turret about a horizontal axis to position said magazines at a first position for receiving compressed pad stacks with magazine walls forming a horizontal stack loading base and a second position at generally 90° from the loading position for orienting the pad stacks with the pads on edge, and means for discharging the pads from said magazine.

5. Apparatus for packing compressible pads including means for forming a vertical stack of pads, first compression means for compressing the stack at a compression station, means including a receiving platform for tipping the stack on edge and conveying the tipped stack to a grouping station having a pad stop plate, means for moving said compressed stack from said compression station onto said receiving platform, means associated with said conveying means for confining the stack to prevent shifting of the pads in the stack during movement to said grouping station, means at said grouping station for grouping the stacks of pads into a horizontal array, said last named means including a movable stop movable into said conveying path at said grouping station to confine said stack until delivery of a second stack, second compression means to compress the horizontal array, said second compression means comprising a carriage having a pressure plate, and means on said carriage for lowering said pressure plate behind the pads at said station and means for moving said carriage and said pressure plate to compress the group of pads against said stop plate upon withdrawal of said movable stop, and means to discharge the compressed horizontal array as a unit from said grouping station.

6. Apparatus in accordance with claim 5 wherein said conveying means includes flights and said receiving platform extends generally horizontally, and including slots in said platform to permit movement of the flights therethrough to pick up stacks from said platform.

7. Apparatus in accordance with claim 5 wherein said conveying means includes a bed with a vertical run and a curved run and side walls extending along said bed and guides above the bed, said guides and said walls defining a conveying channel for confining said stack during movement of said stack along said vertical and said curved run.

8. Apparatus in accordance with claim 5 wherein said second compression means includes a pressure plate and means for moving said pressure plate into said conveying path, a stop, and means for moving said pressure plate against a pad group to press said horizontal array against said stop.

* * * * *